US005265687A

United States Patent [19]

Gray

[11] Patent Number: 5,265,687

[45] Date of Patent: Nov. 30, 1993

[54] DRILLING SHORT RADIUS CURVATURE WELL BORES

[75] Inventor: Benjamin C. Gray, Silver Valley, Canada

[73] Assignee: Kidco Resources Ltd., Silver Valley, Canada

[21] Appl. No.: 884,089

[22] Filed: May 15, 1992

[51] Int. Cl.[5] ..... E21B 7/08

[52] U.S. Cl. ..... 175/62; 175/73

[58] Field of Search ..... 175/73, 107, 40, 104, 175/61, 62

[56] References Cited

U.S. PATENT DOCUMENTS

| | | | |
|---|---|---|---|
| 2,319,236 | 5/1943 | Isaacks et al. | 175/73 |
| 2,687,282 | 1/1952 | Sanders . | |
| 2,694,549 | 11/1954 | James | 175/73 |
| 2,876,992 | 3/1959 | Lindsay | 175/73 |
| 3,068,946 | 12/1962 | Frisby et al. | 175/73 |
| 3,098,534 | 7/1963 | Carr et al. | 175/73 |
| 3,370,657 | 2/1968 | Antle | 175/73 X |
| 3,457,999 | 7/1969 | Massey . | |
| 3,637,032 | 1/1972 | Jeter | 175/73 |
| 3,667,556 | 6/1972 | Henderson . | |
| 3,878,903 | 4/1975 | Cherrington . | |
| 3,903,974 | 9/1975 | Cullen | 175/61 X |
| 4,040,495 | 8/1977 | Kellner et al. . | |
| 4,080,115 | 3/1978 | Sims et al. | 175/107 X |
| 4,220,213 | 9/1980 | Hamilton . | |
| 4,305,474 | 12/1981 | Farris et al. . | |
| 4,416,339 | 11/1983 | Baker et al. . | |
| 4,428,441 | 1/1984 | Dellinger . | |
| 4,449,595 | 5/1984 | Holbert . | |
| 4,456,080 | 6/1984 | Holbert . | |
| 4,465,147 | 8/1984 | Feenstra et al. . | |
| 4,492,276 | 1/1985 | Kamp . | |
| 4,523,652 | 6/1985 | Schuh | 175/61 |
| 4,560,013 | 12/1985 | Beimgraben . | |
| 4,699,224 | 10/1987 | Burton . | |
| 4,739,843 | 4/1988 | Burton . | |
| 4,858,705 | 8/1989 | Thiery . | |
| 4,880,067 | 11/1989 | Jelsma | 175/61 |

*Primary Examiner*—Ramon S. Britts
*Assistant Examiner*—Frank S. Tsay
*Attorney, Agent, or Firm*—Adrian D. Battison; Stanley G. Adew; Murray E. Thrift

[57] ABSTRACT

A supplemental horizontal section is drilled from a lower end of an existing well bore by a drilling tool which provides a short radius of the order of 20 feet of a curved section interconnecting the vertical initial section and the horizontal section. This enables the drilling to take place without expensive monitoring equipment since the distances involved are relatively small. The drilling tool includes a mud motor to which is attached a drilling section including a drill bit at the outer end thereof. The drilling section is connected to the mud motor by a knuckle joint which allows pivotal action about an axis at right angles to the longitudinal axis of the drill bit. A counterbore of increased diameter is formed at the lower end of the existing well bore and the knuckle and drill bit located therein. The knuckle is biased toward one side of the counter bore by a leaf spring so that the longitudinal axis of the drill bit takes up an inclined position with a knuckle bent at a shallow angle. As the drill bit forms a supplemental bore to one side of the main bore the knuckle pivots to gradually increase the angle up to a maximum angle at which the drill bit cuts a curved path. The diameter of the drill bit is selected so that the motor and drill bit section can pass through the curved section to the horizontal section.

20 Claims, 3 Drawing Sheets

DRILLING SHORT RADIUS CURVATURE WELL BORES

BACKGROUND OF THE INVENTION

This invention relates to an apparatus and method for drilling short radius curvature well bores which can be used particularly but not exclusively in the formation of a horizontal well bore at the bottom end of a conventional vertical bore.

Attention has recently been given to techniques for formation of horizontal bore holes at the bottom end of an existing vertical well. This technique is used in various situations in order to increase or recover lost production. It will be appreciated that one or more such horizontal bores can provide increased communication from the production area underground to the vertical bore hole.

In many cases such horizontal bore holes are formed using conventional drilling techniques which act to steer the drilling bit over a gradual curvature so as to move from the initial vertical orientation to a required horizontal orientation. However the conventional techniques require a radius of curvature of the order of several hundred feet so that there is a relatively large length of drilling involved and in addition it is necessary to carefully monitor the location of the drill bit to properly guide the bore holes to the required location.

The need therefore for a technique which will allow a short radius curvature to be developed is therefore apparent. Generally the intention is that the radius of curvature of the bore hole will be certainly less than one hundred feet and preferably of the order of or less than twenty feet. Such a very short radius of curvature allows the length of drilling necessary to reach the horizontal orientation to be relatively short. It is generally not necessary in such short radius curvature to utilize the highly expensive monitoring equipment necessary to properly guide and map the location of the drill bit since the distances involved are short and since it may be possible to utilize the geology of the site to act as a guide.

Attempts have been made to achieve such short radius drilling but to date have had little success due to problems in directional control, both in relation to azimuth and to rate of curvature.

In U.S. Pat. No. 4,858,705 (Thiery) is disclosed a technique for the formation of such small radius curvature bores, the radius of curvature in this patent being stated to be of the order of twenty to thirty meters. However this patent discloses a highly complex arrangement including an electric screw jack so that the equipment involved is extremely expensive and complex to operate.

Another technique known in the industry is to provide a flexible coupling between the drill bit and a down hole mud motor. The drill bit is then steered in its initial curvature by a curved guide surface known generally as a whipstock and the flexible coupling accomodates the curvature of the drilled bore. Examples of this arrangement are shown in U.S. Pat. No. 2,687,282 (Sanders); U.S. Pat. No. 4,495,595 (Holbert); and U.S. Pat. No. 4,456,080 (Holbert). This technique has the disadvantage that it is necessary to withdraw the whole drill string each time an extension piece of the flexible coupling is applied between the mud motor and the drill bit. In addition, this arrangement has had severe directional control problems with many attempts to solve these problems over the years which have not yet achieved success.

U.S. Pat. No. 3,878,903 (Cherrington) discloses a technique for drilling an arcately curved bore hole leading from an initial entry opening which is inclined at a shallow angle to the horizontal so that the bore hole then curves downwardly and then back upwardly to emerge at ground level beyond an obstacle such as a roadway or the like. This patent is therefore not concerned with nor useful with an initial vertical bore hole nor suggests how the device could in any way be used to develop a horizontal supplementary portion connected to an existing vertical well.

SUMMARY OF THE INVENTION

It is one object of the present invention, therefore to provide a method and apparatus which are useful for generating a supplementary horizontal portion of a vertical well while creating a curvature between the vertical orientation and horizontal orientation which is relatively small and preferably of the order of or less than twenty feet while providing good control over direction both in relation to azimuth and rate of curvature.

According to a first aspect of the invention there is provided a method of forming a generally horizontal supplemental bore portion of a vertical production well which extends from a ground end of the production well to a below ground production area and includes a casing extending from the production area to the ground end, the method comprising plugging the production well casing at a position adjacent to but spaced from the bottom end of the well, cutting a cylindrical counterbore portion in the well adjacent the bottom end, the counterbore portion being formed through the casing to define a surface having an internal diameter greater than an external diameter of the casing, transmitting down the well a drilling tool comprising a continuous drilling fluid supply duct, a drive motor including a generally cylindrical stator having a longitudinal axis and a rotor mounted within the stator and rotatable relative to the stator about the axis of the stator, a drill bit for cutting a bore, a generally cylindrical connecting member extending from the stator to the drill bit, bearing means for supporting the drill bit on the connecting member for rotation relative thereto about a longitudinal axis of the bit, and connecting member for communicating rotation of the rotor to the drill bit for driving the drill bit, the connecting member including a knuckle portion which allows bending of the coupling means at the knuckle portion relative to the cylindrical stator from a first position in which the axis of the bit is substantially aligned with the axis of the cylindrical stator through a gradually increasing angle to a second position in which the axis of the bit is offset from the axis of the cylindrical stator to a maximum angle and means for limiting the maximum angle at the second position, the drilling tool being arranged relative to the counterbore portion such that the knuckle portion and the drill bit are located therein at axially spaced positions therealong, applying a force to the drilling tool to move the knuckle portion to contact the surface of the counterbore portion at one side thereof and two move the drilling bit to contact the surface at a side diametrically opposed to said one side such that the axis of the bit is inclined to the axis of the cylindrical stator by an angle less than said maximum angle and such that the axis of the bit is inclined to a longitudinal axis of the well, driving said rotor to rotate the drill bit to cut said supplemental bore in a direction longitudinal of the axis of the drill bit such that as the drill bit moves forwardly the angle of the axis of the drill bit to the axis of the cylindrical stator gradually increases up to said maximum angle to form said supplemental bore position in a curved shape, a cutting diameter of the drill bit being larger than an external diameter of the cylindrical stator and of the connecting member by an amount such that the connecting member and the cylindrical stator follow the bit through the curved supplemental bore.

According to a second aspect of the invention there is provided a drilling tool for forming a generally horizontal supplemental bore portion of a vertical production well bore comprising a coupling member for connection to a continuous drilling mud supply duct, a drive motor connected to said coupling member and including a generally cylindrical stator having a longitudinal axis and a rotor mounted within the stator and rotatable relative to the stator about the axis of the stator, a drill bit for cutting a bore, a generally cylindrical connecting member extending from the stator to the drill bit, bearing means for supporting the drill bit on the connecting member for rotation relative thereto about a longitudinal axis of the bit, and connecting member for communicating rotation of the rotor to the drill bit for driving the drill bit, means allowing bending of the drilling tool between said connecting member and said stator comprising a knuckle portion which freely allows bending of the coupling means at the knuckle portion of the axis of the drill bit relative to the cylindrical stator from a first position in which the axis of the bit is substantially aligned with the axis of the cylindrical stator through a gradually increasing angle to a second position in which the axis of the bit is offset from the axis of the cylindrical stator to a maximum angle and means for limiting the maximum angle at the second position, and means for applying a sideways force to the drilling tool to move the knuckle portion transversely to the bore.

One or more embodiments of the invention will now be described in conjunction with the accompanying drawings.

BRIEF DESCRIPTION OF THE DRAWINGS

In the drawings like characters of reference indicate corresponding parts in the different figures.

DETAILED DESCRIPTION

Figure 1:
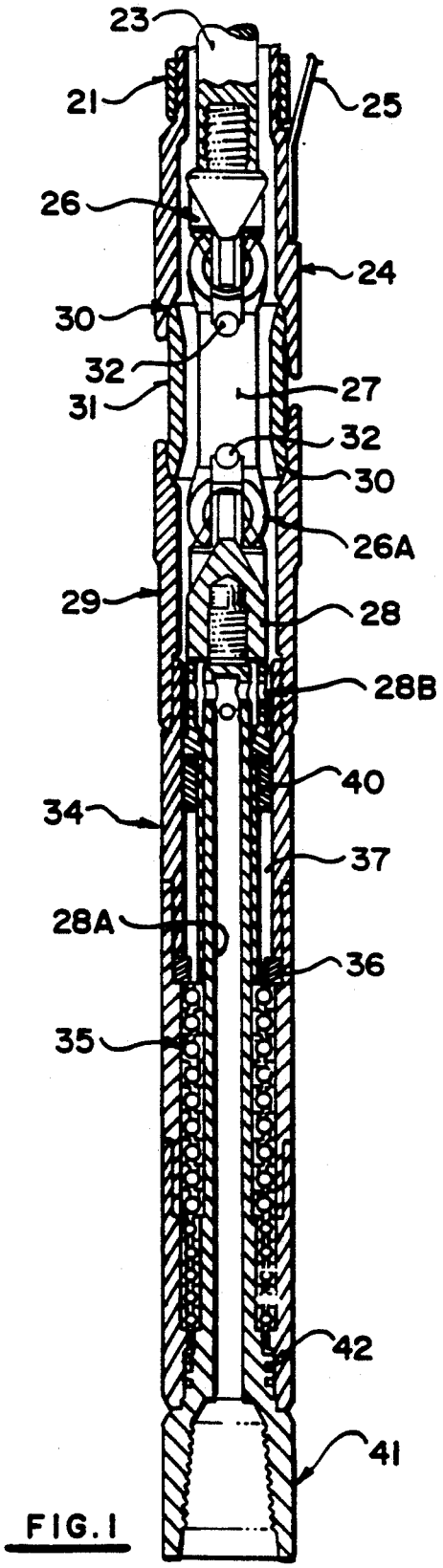
FIG. 1 is a vertical cross sectional view through a drilling tool according to the present invention showing a first part of the drilling tool.
Figure 2:
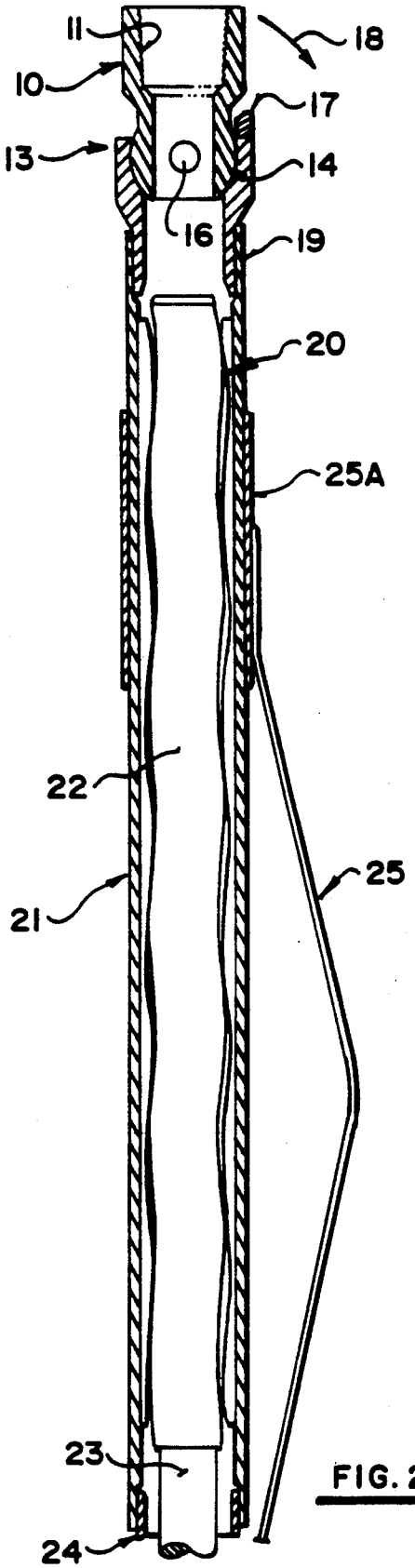
FIG. 2 is a vertical cross section through the same drilling tool showing an upper part of the drilling tool.
Figure 3:
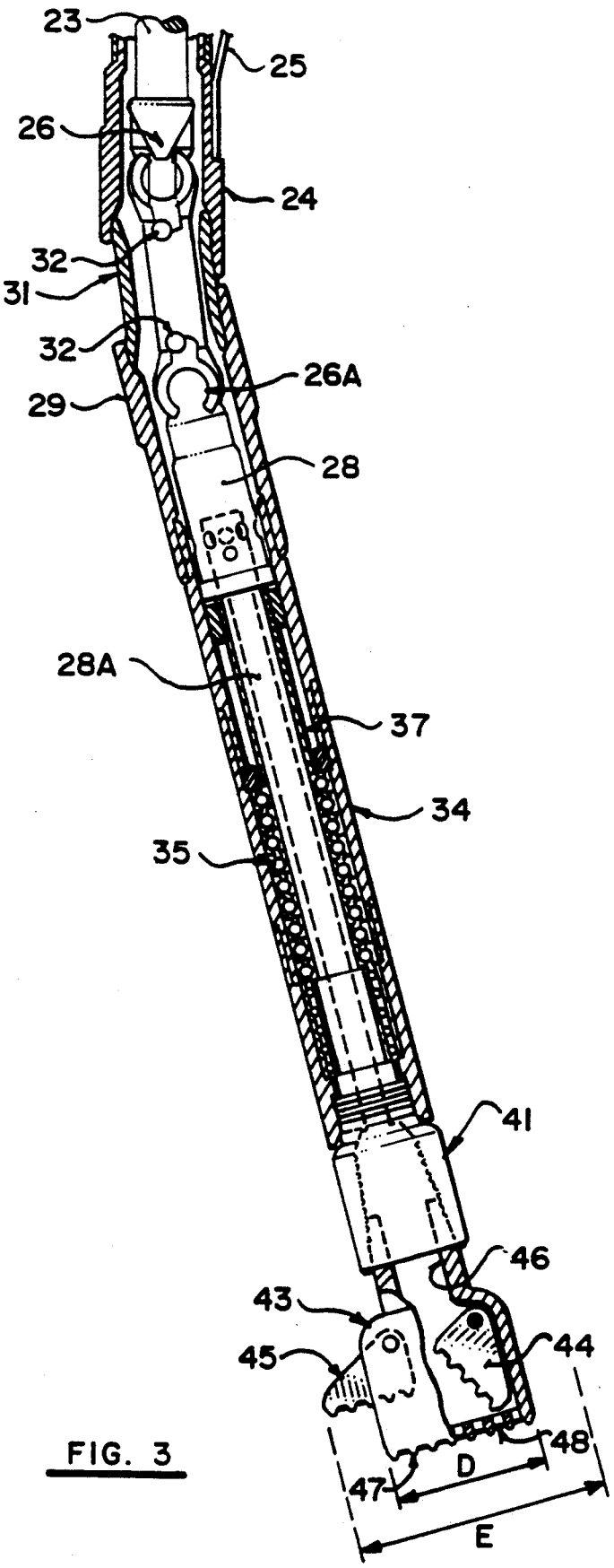
FIG. 3 is a vertical cross sectional view similar to that of FIG. 1 showing the lower part of the tool in an inclined position.

FIGS. 1 and 2 when combined together show the major components of the drilling tool for use in a process of forming a horizontal supplemental portion of an existing vertical well. For convenience of illustration the drill bit attached to the lower end of the tool is omitted from FIG. 1 but is shown in FIG. 3.

Figure 4:
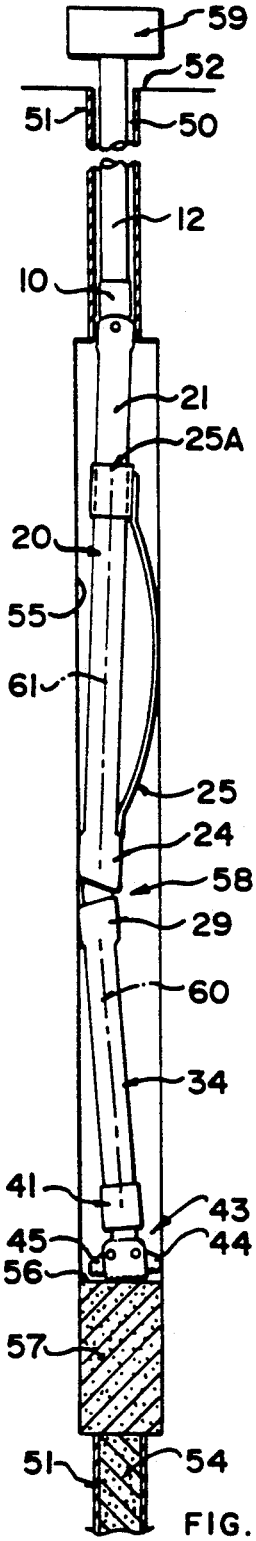
FIG. 4 is a vertical cross section through an existing vertical well showing the drilling tool of FIG. 1 in side elevation and in operation within the vertical well.
Figure 5:
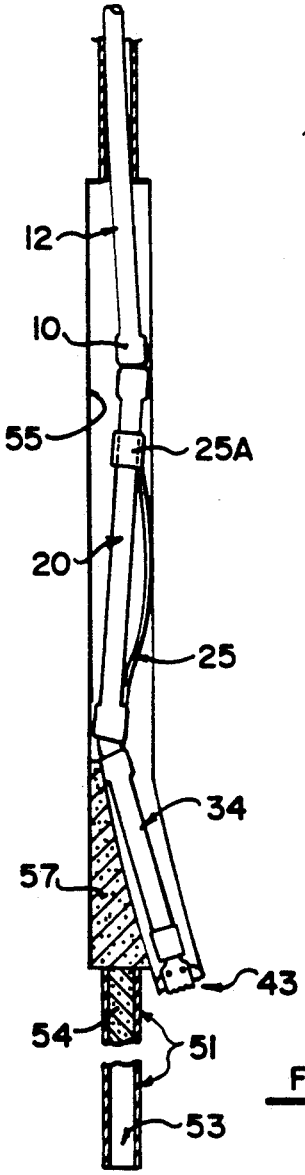
FIG. 5 is a similar view of that of FIG. 4 on a smaller scale for convenience of illustration and showing a subsequent stage after the step shown in FIG. 4.
Figure 7:
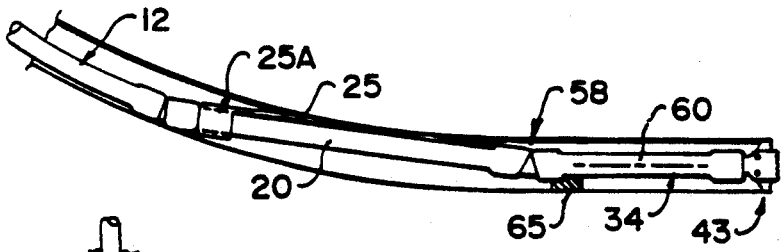
FIG. 7 is a yet further view similar to that of FIGS. 4, 5 and 6 showing the bore reaching the substantially horizontal orientation.
Figure 6:
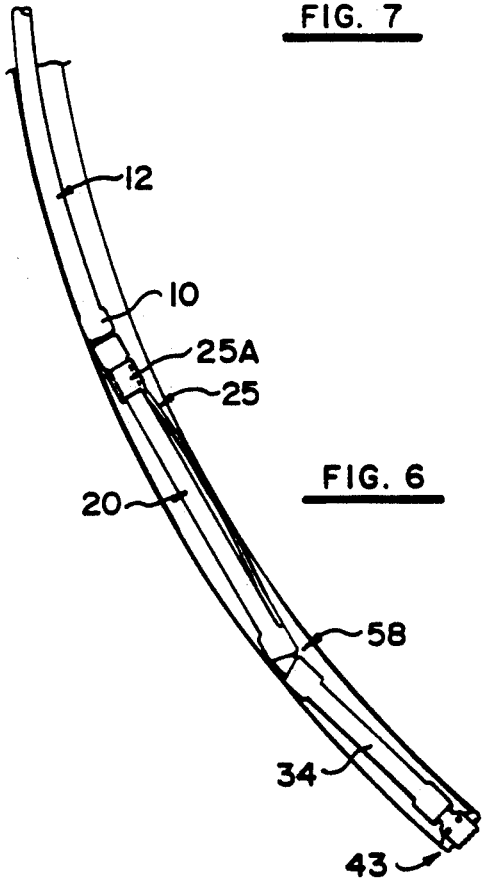
FIG. 6 is a further view similar to that of FIGS. 4 and 5 showing a next stage in the process.

The drilling tool therefore comprises a coupling member 10 having an internal screw thread 11 at one end for connection to a continuous drilling fluid supply duct indicated schematically at 12 in FIGS. 4, 5 and 6. The drilling fluid may comprise a mud or other fluids may be used as are well known. At an opposed end of the coupling member 10 is provided a knuckle connection generally indicated at 13 including a spherical surface 14 on the coupling 10 and a similar surface on a receptacle 15. A transverse pin 16 controls a pivotal action of the coupling 10 relative to the receptacle 15 about the axis of the pin 16. Both the receptacle and the coupling are hollow to allow the communication therethrough of drilling mud from the drilling mud supply duct 12. A restriction member 17 allows pivotal movement of the coupling member 11 in the direction of the arrow 18 from an initial axial aligned orientation but prevents any movement in the opposed direction.

The receptacle 15 is further connected to an upper end 19 of a conventional moineau pump/motor arrangement 20. This comprises a cylindrical stator 21 having a circular cylindrical outer surface and a rotor 22 mounted inside the stator and rotatable relative thereto in response to longitudinal flow of the drilling mud through the cylindrical stator. The rotor includes an output shaft 23 which is visible at the bottom of FIG. 2 and also at the top of FIG. 1 showing the interconnection between the two figures. The moineau pump/motor construction is well known and the device is readily commercially available. The amount of torque generated can be varied in accordance with requirements by a variation in the length of the moineau pump that is the number of lobes of the rotor. The lower end of the cylindrical stator is connected to a further receptacle 24 similar to the receptacle 15. The receptacle 24 is however modified by the application of a flat leaf spring 25 which is welded to one side of the receptacle 24 and extends therefrom back along one side of the cylindrical stator to a sleeve 26 surrounding the stator adjacent the upper end. The sleeve 26 can slide longitudinally of the stator so that the flat leaf spring can be compressed from the expanded position shown in FIG. 2 to a compressed position in which it lies flat along the side of the cylindrical stator. The leaf spring is however formed from a spring steel allowing it to provide a spring bias pushing against the adjacent well sidewall to take up the expanded position shown in FIG. 2. Other types of spring (not shown) can also be used.

At the lower end of the shaft 23 is provided a first universal joint 26 which connects the lower end of the shaft 23 to an intermediate coupling shaft 27. At a lower end of the coupling shaft 27 is provided a second matching universal joint 26A which connects the coupling shaft to an upper end of a drill bit drive shaft 28. The universal couplings 26 and 26A are of a conventional construction so that the details will not be described herein as they are well known to one skilled in the art. The matching pair of universal couplings together with the coupling shaft 27 allow tilting of the longitudinal axis of the cylindrical stator relative to the longitudinal axis of the drill bit drive shaft 28 as described hereinafter. In addition the universal couplings and the coupling shaft allow the eccentric wobbling movement which is a result of the moineau pump/motor construction again as is well known.

The upper universal coupling 26 is housed within the receptacle 24. The lower universal coupling 26A is housed within a second similar receptacle 29. Each of the receptacles 24 and 29 includes a substantially spherical swivel surface 30 which allows pivotal action of each of the receptacles relative to an intervening coupling sleeve 31. The swivelling action is limited to pivotal movement about a transverse axis by studs 32 which interconnect the coupling sleeve 31 and the receptacles to hold them interconnected while allowing pivotal movement about the studs. The studs are mounted on an outside face of the coupling sleeve and engage into indentations on the inside surface of the spherical surfaces of the receptacle 24 and 29.

The two receptacles 24 and 29 and the coupling sleeve 31 thus form a knuckle portion which allows pivotal action from the aligned position shown in FIG. 1 to the inclined position shown in FIG. 3. The amount of pivotal action is limited by the geometry of the parts to a maximum angle of approximately 15° in the direction shown in FIG. 3. In addition a removable restriction member (not shown) prevents bending beyond the zero angle or aligned position shown in FIG. 1. These positions therefore, with the restriction member in place, constitute the extreme positions of the movement and there is therefore no possibility of a pivotal action in the opposite direction from that shown in FIG. 3.

At the end of the receptacle 29 is fastened a drill bit support sleeve 34 within which the drill bit support shaft 28 is mounted. The sleeve and the shaft are generally of a conventional nature and the construction is known to one skilled in the art. In general terms, however, it will be noted that the shaft 28 comprises a substantially hollow shaft portion 28A defining a longitudinal duct through which the drilling mud can pass. At its upper end the shaft includes a transfer section 28B which allows the drilling mud passing along the outside of the rotor and the coupling shaft portion 27 to pass substantially radially inwardly through openings into the interior of the hollow portion 28A. The shaft portion 28A is mounted on bearings 35 connected between the shaft portion and an inside surface of the sleeve 34. The bearings include three separate bearing elements defining bearing directions in the radial direction and in both thrust directions using mounted ball bearings to communicate the forces in the required directions. A locking nut 36 locates the bearings in the area between the outer end or lower end of the shaft portion 28A and the lower end of the sleeve 34. For assembly purposes the sleeve 34 is formed in a number of sections threaded together. The bearings are received within an annular chamber 37 between the shaft and the inside surface of the sleeve 34. This chamber 37 is filled with oil to maintain the bearings under oil pressure. An annular piston 40 surrounds the shaft and acts as a seal between the shaft and the sleeve with one face of the piston 40 pressing against the oil and the other face that is the upper face pressing against the drilling mud so as to seal the drilling mud from the oil and also to apply pressure to the oil.

At the lower end of the shaft is provided a drilling bit coupling member with an internal screw thread into which the bit is fastened. The end cap for the shaft portion 28A is thus indicated at 41 and is sealed relative to the sleeve 34 by sealing rings 42.

A suitable drilling bit is shown in FIG. 3 and is again of a type which is known in the industry. The drilling bit is of a type which can expand from an initial diameter D to an expanded diameter E. The drill bit is generally indicated at 43 and the expansion is effected by a pair of wings 44 and 45. Schematically the wing 44 is shown in a retracted position within a hollow main body of the bit 43 and the wing 45 is shown in an extended position. The drill bit includes a hollow interior 46 for communicating with the hollow interior of the shaft portion 28A to receive the drilling mud therethrough. Each of the end faces of the main drill bit body and the wings 44 and 45 includes a plurality of cutting teeth schematically indicated at 47 together with drilling mud feed holes 48 through which the drilling mud can pass during the drilling action to sweep away the cut material in conventional manner. The wings 44 and 45 can be moved from the retracted position to the expanded position under the pressure from the drilling mud or under pressure from engagement with the material to be drilled, or both. In an initial retracted position, the outside diameter D of the drilling bit is substantially equal to or just slightly greater than the outside diameter of the stator which will in practice be of the order of three to four inches. In the expanded position the diameter E will be of the order of six to eight inches.

Turning now to FIGS. 4 through 7, the method using the tool described above is shown schematically. In FIG. 4 is illustrated an existing well bore 50 within which is provided a production casing 51. The production casing extends from an upper ground position schematically indicated at 52 to a lower bottom end schematically indicated at 53.

The casing thus extends from production equipment at the upper end to the below ground producing area from which the oil is to be extracted. The length of the bore and thus the casing can be between one thousand and fifteen thousand feet at the extremes and often in many cases will be of the order of ten thousand feet. In the event that such a production well can become damaged or clogged due to various circumstances, it is of course highly undesirable simply to abandon the well in view of the very high costs in drilling to such significant depths. The method of the present invention therefore provides a technique for generating one or more supplementary portions from the vertical well which extend radially outwardly from the vertical axis of the well while remaining in the producing zone due to the relatively small radius of curvature between the vertical section and the horizontal section. Drilling therefore only a relatively small length can provide communication from the vertical well to various locations in the production zone.

In the first step of the process of the present invention, the bottom end of the well is plugged by a plug member 54 which is inserted from ground level and located at a position above a damaged area or the like.

In the second step of the process, a counterbore 55 is formed in the bore by a reaming bit again fed into the well from the ground surface. The construction of such a reaming bit is well known and this operates to cut through the casing and into the surrounding material around the casing to provide a cylindrical counter bore having a diameter just greater than the outside surface of the casing. Thus in one example where the inside diameter of the casing is of the order of four inches, the thickness of the casing of the order of ¼ inch and thus the outside diameter of the casing approximately 4.5 inches, the counterbore can be formed to an inside diameter of the order of 6 to 6.5 inches using the reaming bit. The length of the counterbore section is generally sufficient to receive the whole of the drilling tool including the drilling bit up to the coupling member 11.

In the third step cement is introduced into the bore from the plug upwardly along a part of the counterbore section to provide a base through which the initial drilling is to take place. The amount of the cement can vary depending upon the technique employed to introduce the cement. In FIG. 4 an upper end of the cement is indicated at 56. As shown this is adjacent the lower end of the counterbore portion but an alternative arrangement the cement 57 may extend upwardly effectively along the whole of the counterbore portion to be drilled out by the drill bit 43.

In a next step of the process, the drilling tool as described above is fed from a control and support system schematically indicated at 59 at ground level through the existing well bore to the counterbore section 55. During this movement the spring 25 is compressed substantially flat against the side of the cylindrical stator 21 by upward sliding movement of the sleeve 26. In addition the wings 44 and 45 of the drill bit are retracted and in the absence of drilling mud pressure they remain retracted as the drill bit slides along the inside of the casing.

When the drilling tool takes up a position shown in FIG. 4, it will be noted that as the drilling tool enters the counterbore portion 55 the spring 25 acts to bias the knuckle portion indicated at 58 toward one side of the counterbore.

In the position thus shown in FIG. 4 with the knuckle 58 inclined to one side, the longitudinal axis 60 of the drill bit is inclined to a longitudinal axis 61 of the cylindrical stator and more importantly is inclined relative to the longitudinal axis of the well bore. The amount of movement allowed by the differential in diameter between the outside surface of the knuckle and the inside surface of the counter bore will of course vary depending upon the diameters selected and the length of the drill bit section from the knuckle to the drill bit. However in one example this movement may be of the order of 2 to 3 inches providing in a length of the drill bit section of the order of three feet an angle of the order of 3 to 5° of the axis 60 relative to the vertical axis of the well bore.

The supply of drilling mud along the duct 12 acts to commence rotation of the rotor within the cylindrical stator thus driving the drill bit in rotation about its axis. At the same time the mud acts to expand the drill bit to the expanded position as shown. In the expanded position the diameter E of the drill bit is generally selected to be approximately equal to the diameter of the counterbore section 55.

The action of the bit therefore commences to commence drilling through the cement 57 supplied into the counterbore section. As the longitudinal axis 60 of the drill is inclined to the well bore, the bit tends to drill directly along this axis so as to move outwardly through a side wall of the counterbore section as shown in FIG. 5. As this movement towards the sideways direction increases, the angle of the knuckle 58 can gradually increase from an initial position determined by the geometry of the various elements as described above which is less than the maximum angle. Thus as shown in FIG. 5 as the position of the drill bit gradually moves toward that side, the angle gradually increases up to the maximum position illustrated in FIG. 5.

Once the maximum angle is reached, the drill bit continues to cut a bore hole which is curved and follows a circular path from the vertical orientation through to the horizontal orientation. The path is initially not exactly circular in view of the gradually increasing angle but once the angle is at the maximum position the path is then directly circular and the radius of the path will vary depending upon the geometry of the parts as explained above. The steering action arises due to the tendancy to maintain the position shown in FIG. 6. In that position, the knuckle 58 remains in contact with the outside surface of the curved well bore. If due to variations and density of the material or other reasons the drill bit tends to move upwardly thus reducing the radius of curvature, this will cause the knuckle 58 to move away from the sidewall of the well bore due to the fact that the curvature is greater than the maximum angle to which the knuckle can deviate. As soon as the pressure on the side wall from the knuckle 58 is reduced, there is a tendancy to increase a downwards force on the drill bit to tend to reduce the curvature or increase the radius of curvature. Similarly if the pressure on the side wall by the knuckle increases due to a reduction in the curvature of the well bore being formed, this will tend to apply a force on the drill bit tending to turn the drill bit upwardly. These steering forces are formed by a triangle of forces with the apex at the center of the drill bit. One side of the triangle is constituted by a straight line extending from the connector element 10 to the drill bit. The second side of the triangle is formed by a straight line connecting the point of contact to the knuckle with the side wall of the bore and the center of the drill bit. It will be appreciated that the first side of the triangle constitutes the whole of the force should the knuckle leave the side wall. The second side of the triangle constitutes the whole of the force when the pressure of the knuckle against the side wall is a maximum. When a steering action is taking place one or other of the forces is increased to effect the automatic steering arrangement. In practice, therefore, the radius of curvature of the well bore, once the maximum deviation of the knuckle is achieved, is maintained at the minimum value determined by the geometry of the system as explained before due to the self steering action. In the example set forth above with a drill bit of the order of 6.5 inches in diameter E and a length of the drill bit section of the order of 3 feet, the radius of curvature of the curved bore will be of the order of 18 feet.

The diameter of the drill bit is selected relative to the length of the drill section and the length of the mud motor and relative to the maximum angle of the knuckle so that the mud motor, that is the cylindrical stator can just pass along the curved section without wedging due to engaging both sides of the bore at the same time. As the mud motor tends to be the longest part of the equipment, it is this length that determines the geometry and particularly the diameter of the bit which is necessary in order to achieve a radius of curvature of a required minimum amount. The mud motor may have a further knuckle part way along to reduce the diameter required for a particular length of mud motor.

The second knuckle at the connecting member 10 allows slight bending during passage through the curved well bore to reduce stress on the mud supply duct. The direction of the azimuth is controlled by controlling the torque on the drill bit to maintain the axis of the knuckle portion at right angles to the desired azimuth.

Once the orientation has passed through the full curvature from the vertical orientation of the original bore to a required horizontal orientation, the drilling tool can be withdrawn and replaced with a conventional drilling tool to continue in the horizontal orientation. Such a drilling tool may have a reduced diameter bit of the initial diameter D rather than the expanded diameter E since it is no longer necessary for the drilling tool to follow a curvature but can instead pass directly in a straight line horizontally. The direction can be controlled by shims on the outside surface of the drill bit support element to hold the drill bit axis horizontal.

Alternatively, the same drilling equipment may be used using the drilling tool described above but in this case an additional guiding elements 65 are provided located around the drill bit portion and particularly on the underside of the drill bit portion adjacent the knuckle 58. This guide element 65 has a height substantially equal to the difference in radius of the outside edge of the drill bit and the outside surface of the drill bit support section so as to hold the axis of the drill bit directly along a center line of the bore thus causing drilling of a supplemental bore in a straight line from the termination of the curved section described above. Slight variations in orientation of the drill bore can be achieved both upwardly and downwardly by changing the shims or by changes in drill bit pressure. In order to achieve a downward curvature, the restriction member preventing bending of the knuckle in the opposite direction is removed.

The method set forth above therefore enables the drilling of a supplemental section which is horizontal with the radius of curvature between the vertical initial section and the horizontal section being substantially a minimum and certainly less than 30 feet and preferably of the order of 20 feet. The drilling can thus all be maintained within the production zone without the necessity for complex and very expensive monitoring equipment.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of forming a generally horizontal supplemental bore portion of a vertical production well which extends from a ground end of the production well to a below ground production area and includes a casing extending from the production area to the ground end, the method comprising the steps of:

plugging the production well casing at a position adjacent to but spaced from the bottom end of the well;

cutting a cylindrical counterbore portion in the well adjacent the bottom end, the counterbore portion being formed through the casing to define a surface having an internal diameter greater than an external diameter of the casing;

transmitting down the well a drilling tool comprising a continuous drilling mud supply duct, a downhole drive motor including a generally cylindrical stator having a longitudinal axis and a rotor mounted within the stator and rotatable relative to the stator about the axis of the stator, a drill bit for cutting a bore, a generally cylindrical drill bit support member extending from the stator to the drill bit, bearing means for rotatably supporting the drill bit on the drill but support member for rotation relative thereto about a longitudinal axis of the bit, and a drive member for communicating rotation of the rotor to the drill bit for driving the bill bit;

providing between the drill bit support member and the stator a single knuckle portion only which allows bending of the drilling tool only at the single knuckle portion relative to the cylindrical stator generally transverse axis at right angles to the longitudinal axis of the stator from a first aligned position in which the axis of the bit is substantially aligned with the axis of the cylindrical stator only in one direction from the aligned position through a gradually increasing angle to a second position in which the axis of the bit is offset from the axis of the cylindrical stator to a maximum angle and limiting the maximum angle at the second position;

arranging the drilling tool relative to the counterbore portion such that the knuckle portion and the drill bit are located therein at axially spaced positions therealong;

providing a spring on the drilling tool to apply a force to the drilling tool in said one direction to move the single knuckle portion to contact the surface of the counterbore portion at one side thereof and to move the drilling bit to contact the surface at a side diametrically opposed to said one side such that the axis of the bit is inclined to the axis of the cylindrical stator by an angle less than said maximum angle and such that the axis of the bit is inclined to a longitudinal axis of the well;

driving said rotor to rotate the drill bit to cut said supplemental bore in a direction longitudinal of the axis of the drill bit such that, as the drill bit moves forwardly, the angle of the axis of the drill bit to the axis the cylindrical stator gradually increases up to said maximum angle to form said supplemental bore position in a curved shape;

a cutting diameter of the drill bit being larger than an external diameter of the cylindrical stator and of the drill bit support member by an amount such that the drill bit support member and the cylindrical stator follow the drill bit through the curved supplemental bore;

and steering the drill bit to form said curved supplemental bore into a substantially part circular shape by causing the stator to apply pressure directly to the single knuckle portion to remain substantially in contact with the surface of the counterbore portion while maintaining the angle of the axis of the drill bit to the axis of the stator is maintained substantially at said maximum angle.

2. The method according to claim 1 including the step of expanding the drill bit in a radial direction from a first retracted position in which it can slide along the casing to a second expanded position for cutting said supplemental bore of a diameter greater than that of the casing.

3. The method according to claim 2 including expanding the drill bit to a diameter substantially equal to that of the counterbore portion.

4. The method according to claim 2 wherein the drill bit is expanded in response to pressure from the drilling mud.

5. The method according to claim 1 wherein the force is applied to the drilling tool to move the knuckle portion to contact the surface of the counterbore portion by said spring mounted on the drilling tool on a side thereof opposite to said one side for engaging the well at a side thereof opposite to said one side said spring being compressible against said side of the drilling tool.

6. The method according to claim 5 wherein the spring comprises a leaf spring having one end thereof slidable longitudinally of the drilling tool so as to increase and decrease a maximum spacing of the leaf spring from the drilling tool.

7. The method according to claim 1 wherein the maximum angle is of the order of 15°.

8. The method according to claim 1 including providing a second knuckle portion arranged between the supply duct and the cylindrical stator, the second knuckle portion allowing bending of the cylindrical stator relative to the supply duct about an axis of bending parallel to the axis of bending of said knuckle portion, the direction of bending of the second knuckle portion being the same as the direction of bending of said knuckle portion to allow passage of the first and second knuckle portion through the curved well bore.

9. The method according to claim 1 including steering the drill bit such that when the axis of the drill bit reaches horizontal the drill bit continues in the horizontal direction.

10. The method according to claim 9 wherein the drill bit is steered by providing a shim adjacent the knuckle portion for sliding along a bottom surface of the bore, the shim having a thickness relative to the diameter of the coupling portion and relative to the diameter of the drill bit to support the axis of the drill bit parallel to the horizontal bottom surface of the bore.

11. The method according to claim 1 wherein the curved supplemental portion has a radium less than 20 feet.

12. The method according to claim 1 comprising controlling the direction of azimuth by controlling the torque on the drill bit to maintain the axis of the knuckle portion at right angles to the desired azimuth.

13. A method of forming a generally horizontal supplemental bore portion of a vertical well comprising the steps of:

transmitting down the vertical well a drilling tool comprising a continuous drilling mud supply duct, a downhole drive motor including a generally cylindrical stator having a longitudinal axis and a rotor mounted within the stator and rotatable relative to the stator about the axis of the stator, a drill bit for cutting a bore, a generally cylindrical drill but support member extending from the stator to the drill bit, bearing means for rotatably supporting the drill bit on the drill bit support member for rotation relative thereto about a longitudinal axis of the bit, and a drive member for communicating rotation of the rotor to the drill bit for driving the bill bit;

providing between the drill bit support member and the stator a single knuckle portion only which allows bending of the drilling tool only at the single knuckle portion relative to the cylindrical stator generally about a transverse axis at right angles to the longitudinal axis of the stator from a first aligned position in which the axis of the bit is substantially aligned with the axis of the cylindrical stator only in one direction from the aligned position through a gradually increasing angle to a second position in which the axis of the bit is offset from the axis of the cylindrical stator to a maximum angle and limiting the maximum angle at the second position;

arranging the drilling tool relative to the vertical well such that the knuckle portion and the drill bit are located therein at axially spaced positions therealong;

providing a spring on the drilling tool to apply a force to the drilling tool in said one direction to move the single knuckle portion to contact the surface of the counterbore portion at one side thereof and to move the drilling bit to contact the surface at a side diametrically opposed to said one side such that the axis of the bit is inclined to the axis of the cylindrical stator such that the axis of the bit is inclined to a longitudinal axis of the well;

driving said rotor to rotate the drill bit to cut said supplemental bore in a direction longitudinal of the axis of the drill bit such that, as the drill bit moves forwardly, the angle of the axis of the drill bit to the axis of the cylindrical stator is arranged at said maximum angle to form said supplemental bore position in a curved shape;

a cutting diameter of the drill bit being larger than an external diameter of the cylindrical stator and of the drill bit support member by an amount such that the drilling bit support member and the cylindrical stator follow the drill bit through the curved supplemental bore;

and steering the drill bit to form said curved supplemental bore into a substantially part circular shape by causing the stator to apply pressure directly to the single knuckle portion to remain substantially in contact with the surface of the counterbore portion while maintaining the angle of the axis of the drill bit to the axis of the stator is maintained substantially at said maximum angle.

14. The method according to claim 13 including the step of expanding the drill bit in a radial direction from a first retracted position in which it can slide along the casing to a second expanded position for cutting said supplemental bore of a diameter greater than that of the casing.

15. The method according to claim 14 wherein the drill bit is expanded in response to pressure from the drilling mud.

16. The method according to claim 13 wherein the force is applied to the drilling tool to move the knuckle portion to contact the surface of the counterbore portion by the spring which is mounted on the drilling tool on a side thereof opposite to said one side for engaging the well at a side thereof opposite to said one side said spring being compressible against said side of the drilling tool.

17. The method according to claim 16 wherein the spring comprises a leaf spring having one thereof slidable longitudinally of the drilling tool so as to increase and decrease a maximum spacing of the leaf spring from the drilling tool.

18. The method according to claim 13 wherein the maximum angle is of the order of 15°.

19. The method according to claim 13 including providing a second knuckle portion arranged between the supply duct and the cylindrical stator, the second knuckle portion allowing bending of the cylindrical stator relative to the supply duct about an axis of bending parallel to the axis of bending of said knuckle portion, the direction of bending of the second knuckle portion being the same as the direction of bending of said knuckle portion to allow passage of the first and second knuckle portion through the curved well bore.

20. The method according to claim 13 comprising controlling the direction of azimuth by controlling the torque on the drill bit to maintain the axis of the knuckle portion at right angles to the desired azimuth.

* * * * *